US005393023A

United States Patent [19]

Callan

[11] Patent Number: 5,393,023

[45] Date of Patent: Feb. 28, 1995

[54] COLLAPSIBLE BAG HOLDER

[76] Inventor: George Callan, 226 Cranbrook Ave., Toronto, Ontario, M5M 1M7, Canada

[21] Appl. No.: 80,185

[22] Filed: Jun. 23, 1993

[51] Int. Cl.[6] ..... B65B 67/00

[52] U.S. Cl. ..... 248/97; 248/150; 248/153; 248/166

[58] Field of Search ..... 248/97, 95, 150, 152, 248/153, 149, 165, 166, 160, 604; 220/551, 720, 490, 489; 383/33, 34, 34.1

[56] References Cited

U.S. PATENT DOCUMENTS

| | | | |
|---|---|---|---|
| 130,051 | 7/1872 | Hollidge | 248/97 |
| 651,773 | 6/1900 | Smith | 248/97 |
| 1,378,050 | 5/1921 | Morris . | |
| 1,714,308 | 3/1928 | Gunderson . | |
| 2,496,757 | 9/1946 | Sieling . | |
| 3,161,391 | 12/1964 | Bahnsen | 248/99 |
| 3,614,041 | 10/1971 | Koger | 248/97 |
| 3,627,242 | 12/1971 | Vandermast | 248/97 |
| 4,050,492 | 9/1977 | Veilleux . | |
| 4,157,801 | 6/1979 | Elmer . | |
| 4,196,880 | 4/1980 | Hynes . | |
| 4,692,050 | 9/1987 | Kaufman | 248/97 X |
| 4,899,967 | 2/1990 | Johnson . | |
| 5,058,839 | 10/1991 | Stevens . | |
| 5,080,237 | 1/1992 | Hefner . | |
| 5,167,390 | 12/1992 | Baghdadi . | |

FOREIGN PATENT DOCUMENTS

| | | | |
|---|---|---|---|
| 986896 | 4/1976 | Canada . | |
| 2133282 | 7/1984 | United Kingdom | 248/99 |

*Primary Examiner*—Karen J. Chotkowski
*Attorney, Agent, or Firm*—Dowell & Dowell

[57] ABSTRACT

A bag holder for use with a flexible bag is disclosed. The bag holder has a lower support member, an upper support and a plurality of resiliently flexible struts. The top end portion of each strut is connected to the upper support member and is pivotal in a plane tangential to the upper support member. The bottom end portion of each strut is connected to the lower support member and is pivotal in a plane tangential to the lower support member. The bag holder has an operative position where the upper support member is vertically spaced from the lower support member and a stored position where the lower support member, the upper support member and the plurality of struts are generally in the same plane. The bag holder is moved from the operative position to the stored position by twisting the upper support member relative to the lower support member and pushing the upper support member into generally the same plane as the lower support member. The bag holder also includes a kit or disassembled form.

25 Claims, 7 Drawing Sheets

COLLAPSIBLE BAG HOLDER

FIELD OF INVENTION

This invention relates to bag holders and in particular to collapsible bag holders capable of holding flexible bags.

BACKGROUND OF THE INVENTION

The use of flexible bags is wide spread and in particular in the field of lawn and garden maintenance. It is desirable to provide a device for supporting a bag while it is being filled with lawn and garden refuse and the like. Accordingly various bag holders have been proposed.

For example, U.S. Pat. No. 5,058,839 issued to Harry C. Stevens on Oct. 22, 1991 shows a bag holder having a pair of circular support members interconnected by a pair of legs. Each leg pivots at its connection to the circular support members and at its mid point. Accordingly the bag holder can be collapsed into a folded position. This bag holder would be relatively expensive to manufacture because of the detail of each hinge, point. As well, this bag holder would take up a relatively large amount of space when it is transported because of the air space in the centre of the collapsed device.

Another bag holder is shown in U.S. Pat. No. 4,899,967 issued to Austin E. Johnson on Feb. 13, 1990. This bag holder has a circular member, an inner tube-type member, a plurality of arcuate members, a plurality of vertical members clipped to the arcuate members and a plurality of clamps to hold the device together. A bag is supported between the inner tube-type member and the arcuate members. The vertical members haw a pointed bottom end so that the members can be driven into the ground. To store the device the vertical members are simply detached from the arcuate members. This device is limited because it can only be used in locations where the vertical members can be driven into the ground. Therefore it could not be used on a terrace, a deck or inside. As well, since the plurality of members are not attached together it would be easy to misplace a member when the device is not in use.

Another bag holder is shown in U.S. Pat. No. 4,157,801 issued to Frederick L. Ehner on Jun. 12, 1979. This bag holder has a circular top support; member, a circular bottom support member and three vertical members releasably connecting the top member to the bottom member. A plurality of attaching joint members connect the members together. The device is designed to be knocked down into its various elements for storage. When the device is knocked down and stored however it would be easy to lose a member.

Taken alone or in combination none of these bag holders show a device which is relatively easy to assemble, relatively easy and cost effective to manufacture, and need not be taken apart to store.

SUMMARY OF THE INVENTION

The present invention is a bag holder for use with a flexible bag. The bag holder has a lower support member, an upper support and a plurality of resiliently flexible struts. The top end portion of each strut is connected to the upper support member and is pivotal in a plane tangential to the upper support member. The bottom end portion of each strut is connected to the lower support member and is pivotal in a plane tangential to the lower support member. The bag holder has an operative position where the upper support member is vertically spaced from the lower support member and a stored position where the lower support member, the upper support member and the plurality of struts are generally in the same plane. The bag holder is moved from the operative position to the stored position by twisting the upper support member relative to the lower support member and pushing the upper support member into generally the same plane as the lower support member.

According to another aspect of the invention the bag holder is provided in a kit or disassembled form.

According to a further aspect of the invention the upper support member comprises two sections which are pivotally attached to each other such that each section is pivotal towards the other along its circumference. This aspect allows for "closure" of the upper support member and thus the supported flexible bag.

According to a still further aspect of the invention the bag holder includes a means for preventing each strut from reaching the vertical position such that pressure on the upper support member will tend to bring the upper support member closer to the lower support member. This aspect allows the bag holder to automatically adjust to bags of different sizes.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE PREFERRED EMBODIMENT

Figure 1:
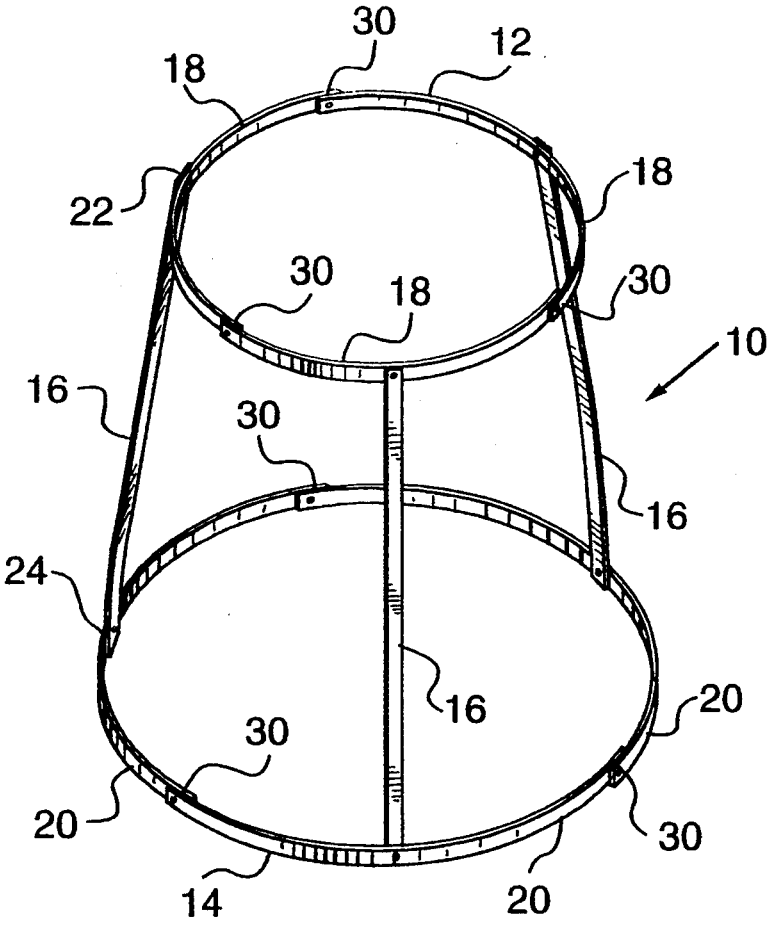
FIG 1 is a perspective view of the bag holder of the present invention.
Figure 2:
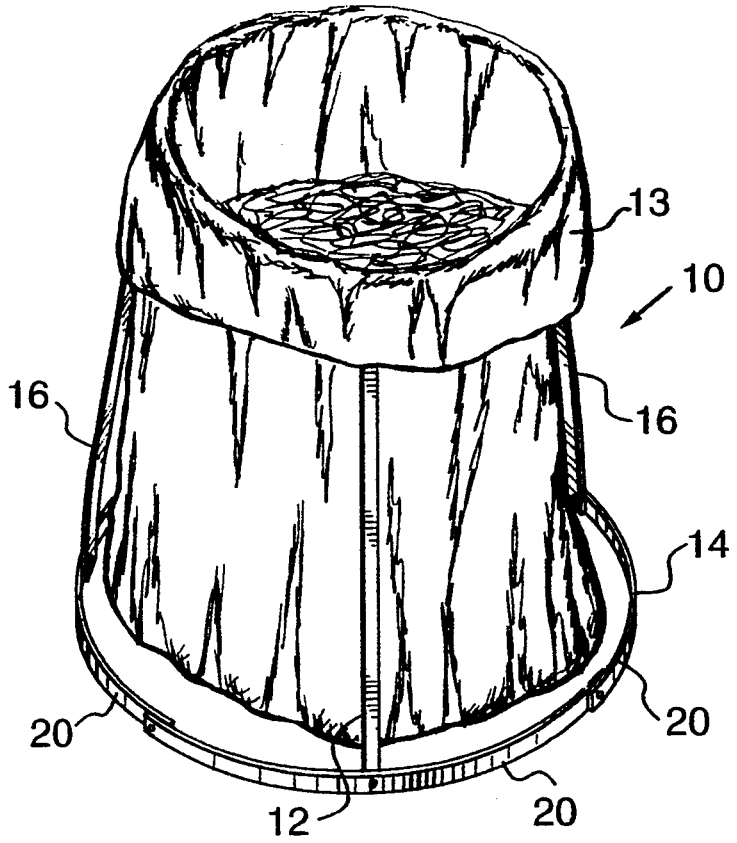
FIG. 2 is a perspective view of the bag holder of FIG. 1 shown holding a flexible bag which is filled with leaves.

Referring to drawings and in particular to FIGS. 1 and 2, the collapsible bag holder is shown generally at 10. Bag holder 10 includes an upper support member 12, a lower support member 14 and a plurality of struts 16 connected between support members 12 and 14. Bag holder 10 is for use with a flexible bag 11, the assembled combination being shown in FIG. 2.

Upper support member 12 has three upper segments 18, each having the same length and shape. The three upper segments 18 are connected together longitudinally to form a ring. The circumference of the upper support member is less than the circumference of the opening of the flexible bag 11 so that the bag can be pulled up through the upper support member 12 and the upper edge 13 of the bag can be draped over the upper support member 12 as shown in FIG. 2.

Lower support member 14 has three lower segments 20, each having the same length and shape. The three lower segments 20 are connected together longitudinally to form a ring. Preferably the circumference of the circular lower support member 14 is greater than the circumference of the circular upper support member 12 and greater than the circumference of a distended flexible bag 11. This will ease in the removal of bag holder 10 from a filled bag.

Struts 16 are fabricated of a resilient flexible material. There are three struts 16 and they are spaced equidistant around the upper support member 12 and lower support member 14. Each strut 16 is attached in the centre portion of upper segments 18 and the centre portion of lower segments 20. Each strut 16 has a top end portion 22 and a bottom end portion 24. The top end portion 22 of each strut 16 is connected to the outside of the upper support member 12 and the connection is pivotal in a plane tangential to the upper support member 12 as shown in the FIGS. 3 and 4. The bottom end portion 24 of each strut 16 is connected to the inside of the lower support member 14 and the connection is pivotal in a plane tangential to the lower support member 14.

Figure 3:
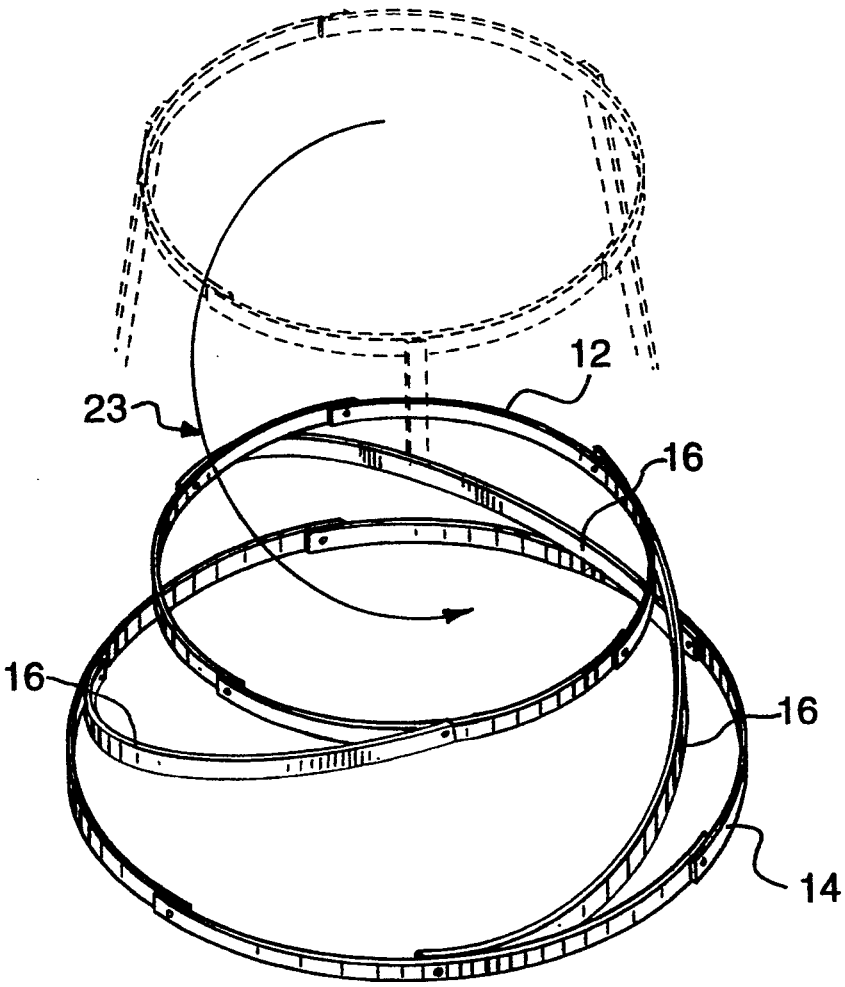
FIG. 3 is a perspective view of the bag holder of FIG. 1, showing the bag holder partially collapsed.
Figure 4:
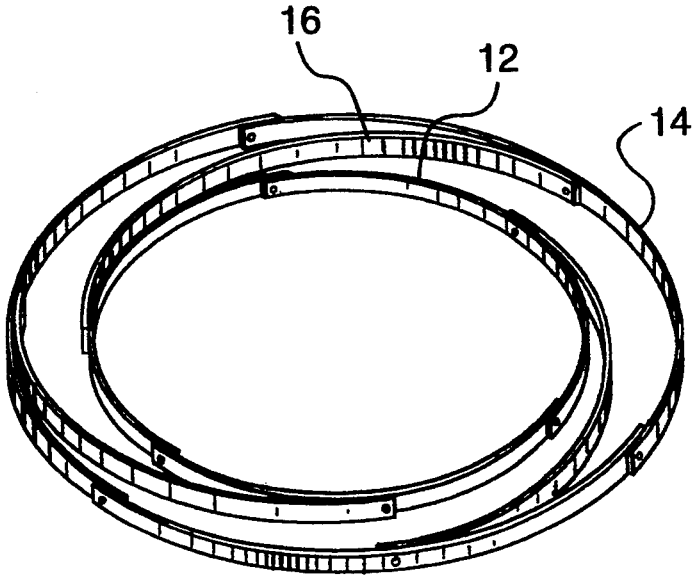
FIG. 4 is a perspective view of the bag holder of FIG. 1, showing the bag holder collapsed.

FIG. 1 shows bag holder 10 in the operative position and as can be seen upper support member 12 is vertically spaced from lower support member 14 and strut 16 is generally perpendicular to lower support member 14 and generally perpendicular to upper support member 12. FIG. 3 shows bag holder 10 partially collapsed. FIG. 4 shows bag holder 10 collapsed and as can be seen lower support member 14, upper support member 12 and struts 16 are all in the same plane. To collapse bag holder 10, upper support member 12 is twisted relative to lower support member 14 in the direction of arrow 23 with upper support member 12 remaining generally concentric with lower support member 14 until the bag holder 10 is in the collapsed position. As shown in FIG. 4, in the collapsed position upper support member 12 is concentrically disposed in relation to the lower support member 14.

Since struts 16 are made of resiliently flexible material when flexed they exert a force along their longitudinal axis and they will tend to straighten when flexed. When upper support member 12 is pulled out of the plane of the collapsed device the flexed struts 16 can straighten out by pivoting about the pivotal connection between top end portion 22 and upper support member 12 and pivotal connection between bottom end portion 24 and lower support member 14. In other words, once upper support member 12 is moved out of the plane of the collapsed device struts 16 exert a force having components in the plane of the supports and perpendicular to the plane of the support members. However, in the collapsed position struts 16 are flexed thereby exerting a pulling force on circular support member 12 which acts only in the plane of the collapsed device.

The bag holder in the disassembled or kit form will now be described wherein designation numbers raised to the prime refer to the same elements in the disassembled or kit form.

Figure 5:
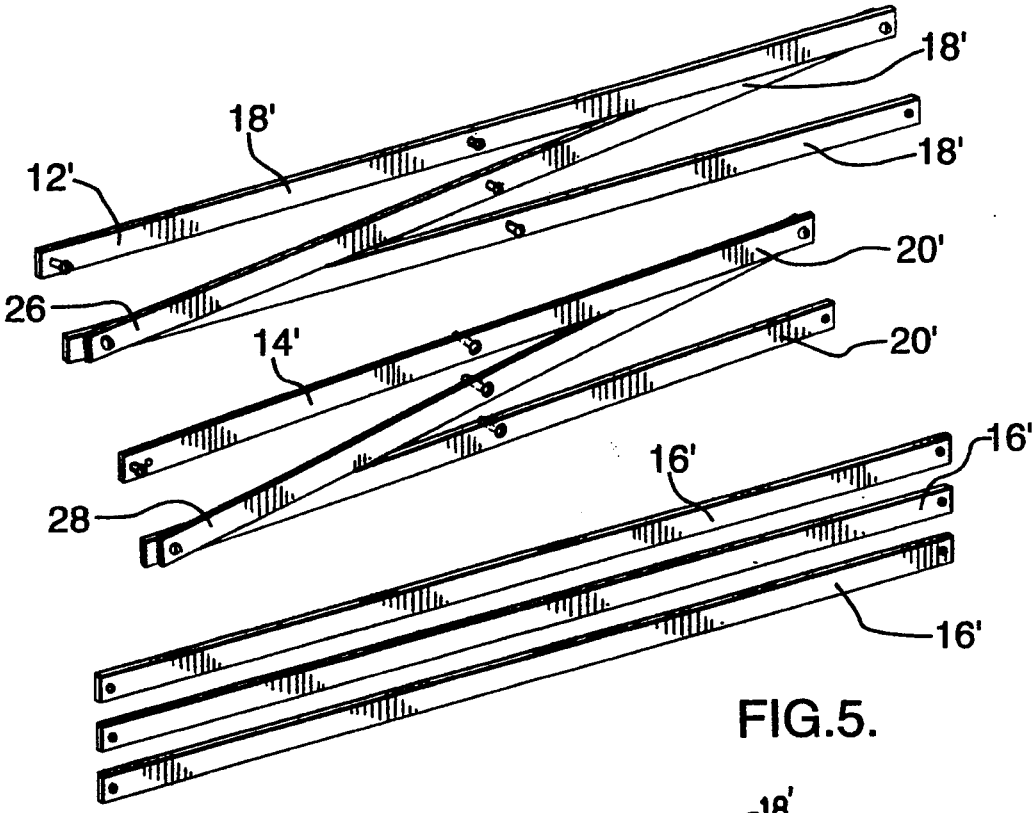
FIG. 5 is a perspective view of the bag holder of FIG. 1, shown in the disassembled kit form.
Figure 6:
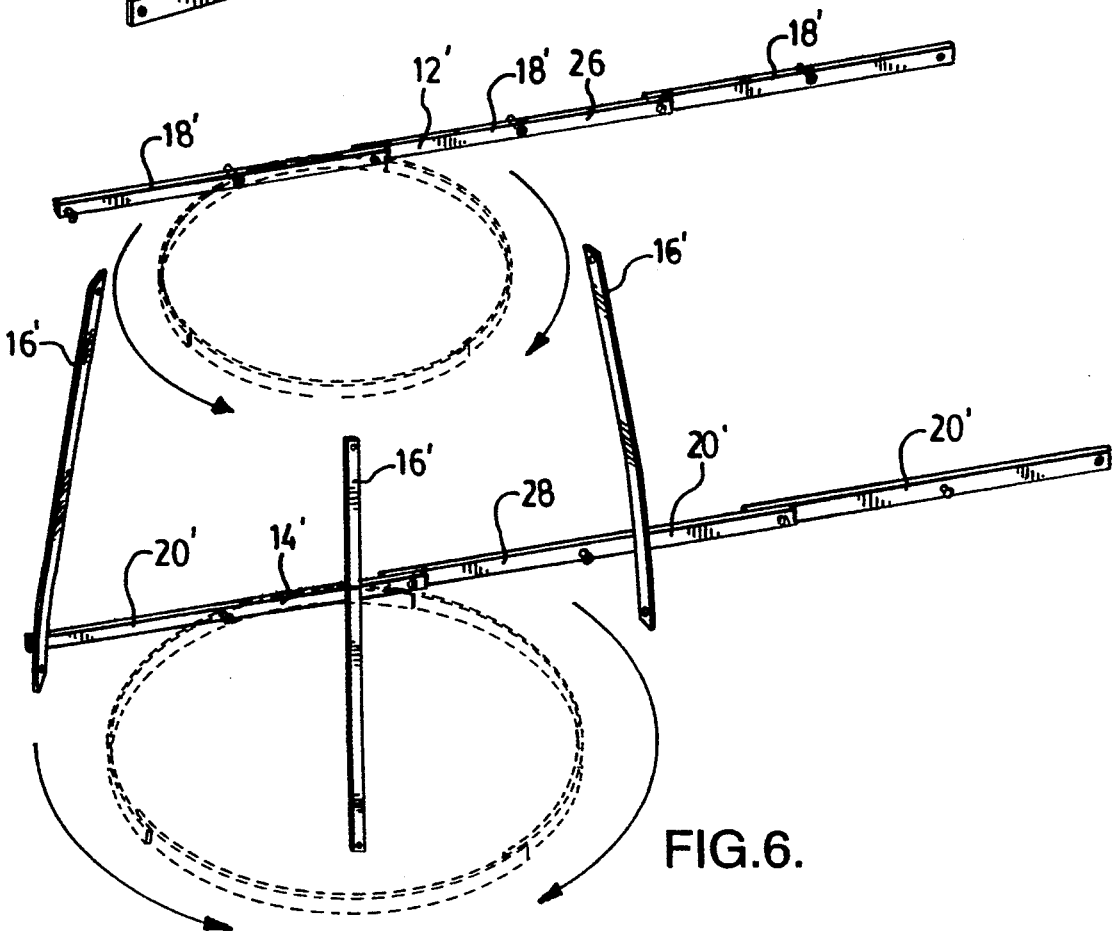
FIG. 6 is a perspective view of the bag holder of FIG. 1, shown partially assembled.

FIG. 5 shows bag holder 10 in the kit form. The kit includes upper support member 12', lower support member 14' and struts 16'. Upper support member 12' includes three upper segments 18'. Each upper segment 18' is the same size and shape. The middle upper segment 26 is attached at each end to an upper segment 18'. Therefore upper support member 12' has two free ends. The segments are pivoted into end to end relation as shown in FIG. 6 and then the two free ends are then joined together as shown in phantom. Upper segments 18 are held in position with attachment assembly 30 described below. Upper strut fasteners 27 extend outwardly when upper segments 18' are joined to form upper support member 12.

Lower support member 14' includes three lower segments 20'. Each lower segment 20 is the same size and shape. The middle lower segment 28 is attached at each end to a lower segment 20'. Therefore the lower support member 14' has two free ends. The segments are pivoted into end to end relation as shown in FIG. 6 and then the two free ends are then joined together as shown in phantom. Lower segments 20 are held in position with attachment assembly 30 described below. Lower strut fasteners 29 extend inwardly when lower segments 20' are joined to form lower support member 14.

Figure 7:
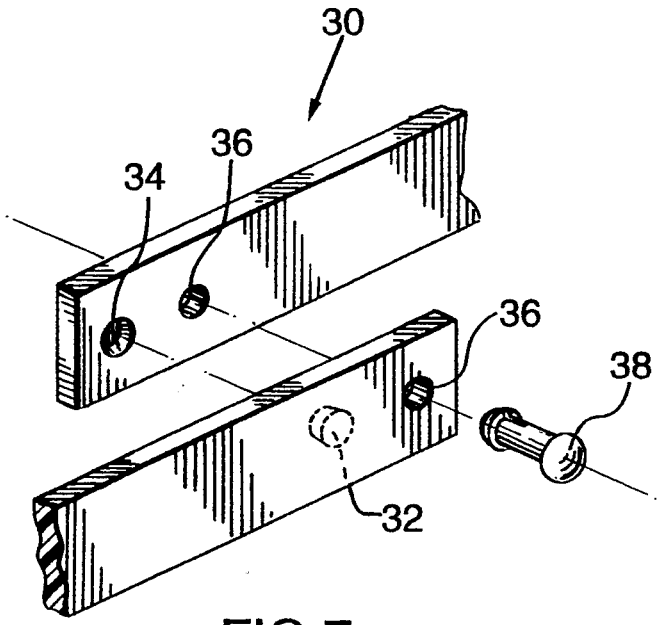
FIG. 7 is an enlarged perspective blown apart view of an attachment assembly.
Figure 8:
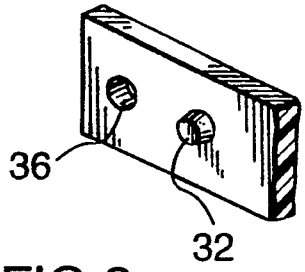
FIG. 8 is an enlarged perspective view of one side of the attachment assembly.
Figure 9:
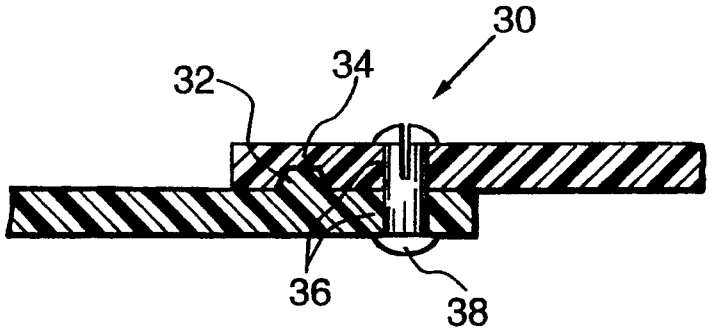
FIG. 9 is an enlarged sectional view of the attachment assembly of FIG. 7.

FIGS. 7–9 shows an attachment assembly generally at 30. This attachment assembly is used to attach upper segments 18 to form upper support 12 and lower segments 20 to form lower support 14 as indicated by reference 30 in FIG. 1. Attachment assembly 30 includes a tapered post 32 on one member and a corresponding tapered indentation 34 on the other member to be attached. Indentation 34 is dimensioned so that post 32 fits snugly therein, however the taper allows for tolerance in fitting. Each member has an aperture 36 for receiving stud 38. Aperture 36 is dimensioned so that stud 38 fits snugly therein. Where aperture 36 is proximate to the end of the member as shown in FIGS. 7 and 8 and post 32 is positioned inside of the aperture 36, the member with the post 32 is the outside member of the attachment assembly 30 so that when the segments are bent to form a support member the bending of segments push the post and indentation into closer engagement and make it more difficult to move the members out of engagement. Alternatively where the post is closer to the end of the segment than the aperture (not shown) that segment should be the inside segment so that the bending of the segment will force the post and the aperture into closer engagement.

Preferably the upper segments 18 are made from a LDPE (low density polyethylene) or like material, the lower segments 20 are made from PVC (polyvinyl chloride) or like material and the struts 16 are made from PVC (polyvinyl chloride) or like material. Typically the members are manufactured from material that is 0.125 inches thick by 0.5 inches wide. It will be appreciated by those skilled in the art that a number of different sizes and materials could be used effectively.

A number of variations on the bag holder will now be discussed wherein only those difference from the above bag holder will be discussed.

Figure 10:
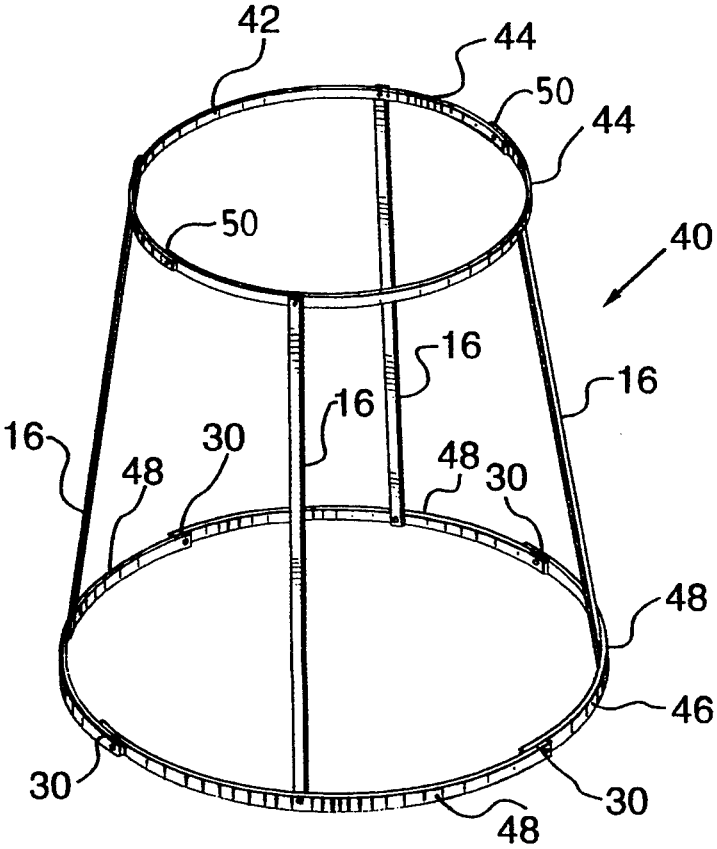
FIG. 10 is a perspective view of a second alternate embodiment of the bag holder of the present invention.
Figure 11:
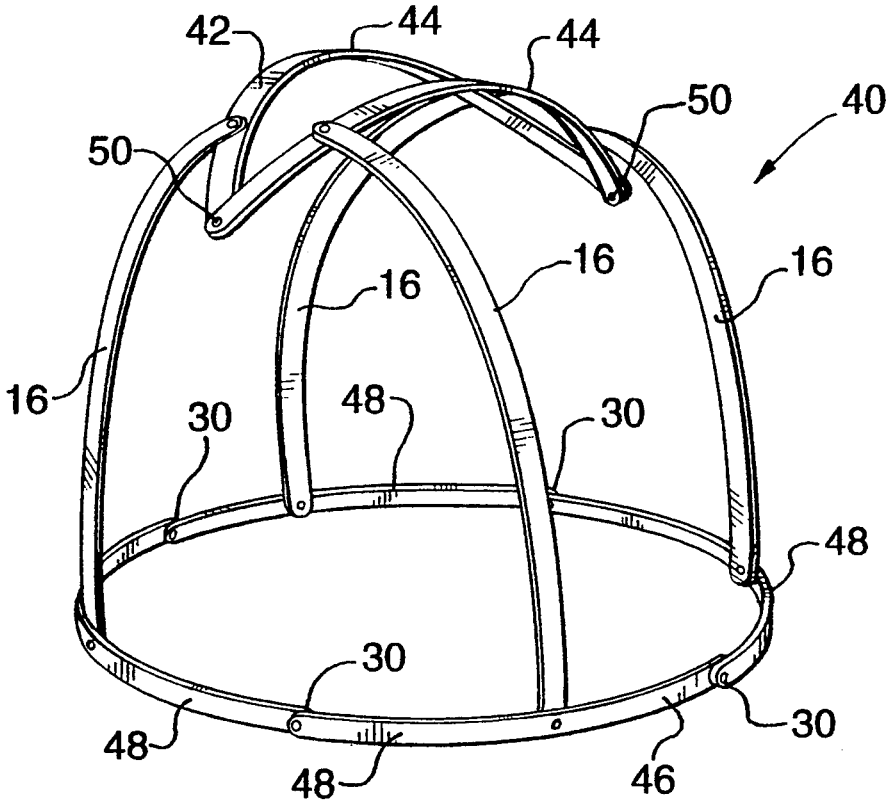
FIG. 11 is a perspective view of the bag holder of FIG. 10 showed with the upper support member in the close position.
Figure 12:
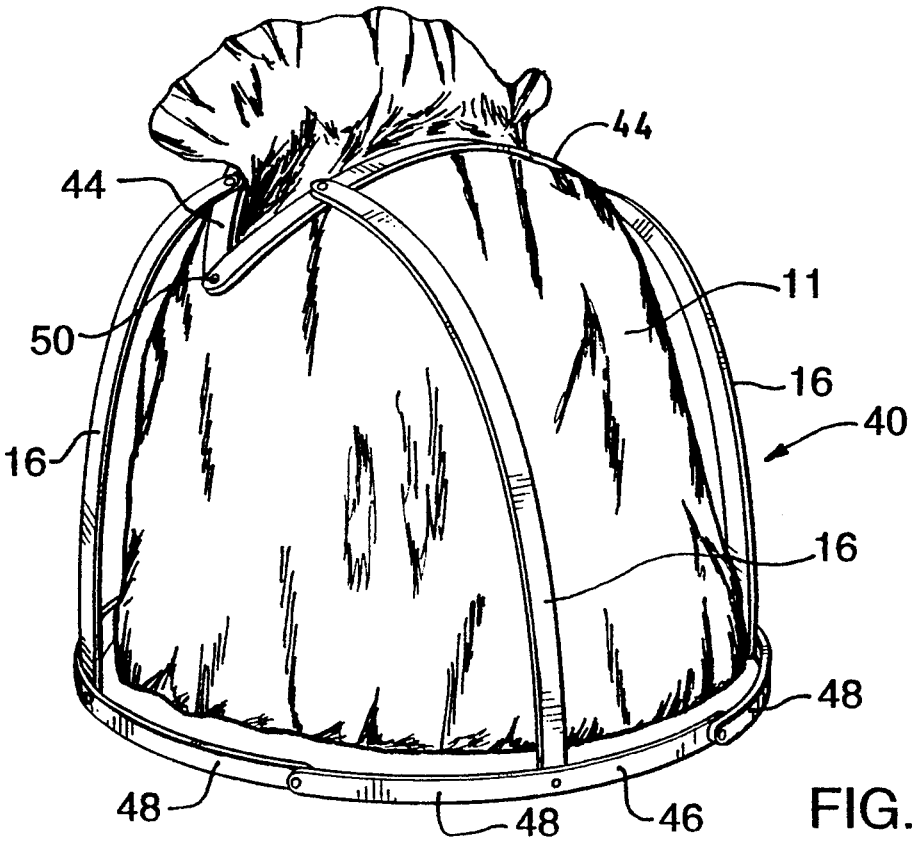
FIG. 12 is a is a perspective view of the bag holder of FIG. 10 showed holding a filled flexible; bag and showed with the upper support member in the closed position.

FIGS. 10 through 12 show an alternate embodiment, shown generally at 40, of a bag holder embodying the present invention and including a closure feature. The upper support member 42 has two upper segments 44 and lower support member 46 has four lower segments 48. Four struts 16 attach upper support member 42 to lower support member 46. Struts 16 are attached to the lower support member 46 in the middle of each lower segment 48. Struts 16 are attached to the upper support member 42 equidistant from each other. Two struts 16 are attached to each upper segment 44 such that the connection between the segments 44 is equidistant form each adjacent strut 16.

Figure 13:
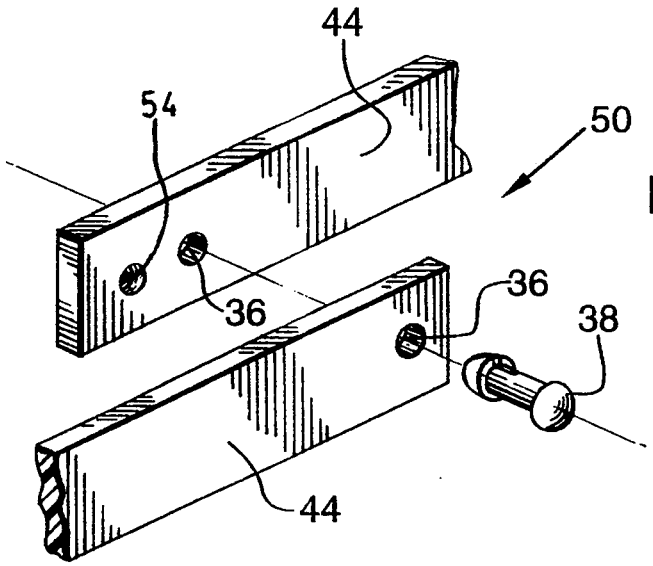
FIG. 13 is an enlarged blown apart perspective view of an attachment assembly for use with the bag holder shown of FIG. 10.
Figure 14:
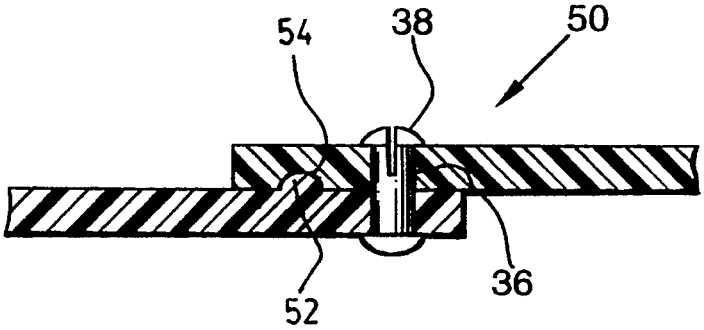
FIG. 14 is an enlarged sectional view of the attachment assembly shown in FIG. 13.

Attachment assembly 50 for use with the closure feature is shown in FIGS. 13 and 14. This attachment assembly is used to attach the two upper segments 44 together and is shown in FIGS. 10–12 at reference number 50. Attachment assembly 50 includes an aperture 36 in each segment for receiving stud 38. A detent 52 on one of the segments 44 engages an indent 54 on the other segment 44 as best seen in FIG. 14. Detent 52 and indent 54 hold the segments in alignment relative to one another but allow for the segment to be pivoted relative to one another when pressure is applied. This allows the holder to be "closed" as shown in FIG. 12. Detent is positioned so that the curve of the segment 44 forces the detent 52 into engagement with the indent 54, as discussed above with regard to attachment assembly 30.

As can be seen in FIGS. 11 and 12 attachment assembly 50 allows segments 44 to be brought together so that the bag can be "closed". The advantage of this embodiment is that it allows the user to close the bag under certain circumstances. For instance the user can close the bag and hold the bag and the bag holder with one hand so that it can easily be moved from one location to another. As well, if the bag contains materials having undesirable odours the bag can be temporarily closed without removing it from the bag holder.

Figure 15:
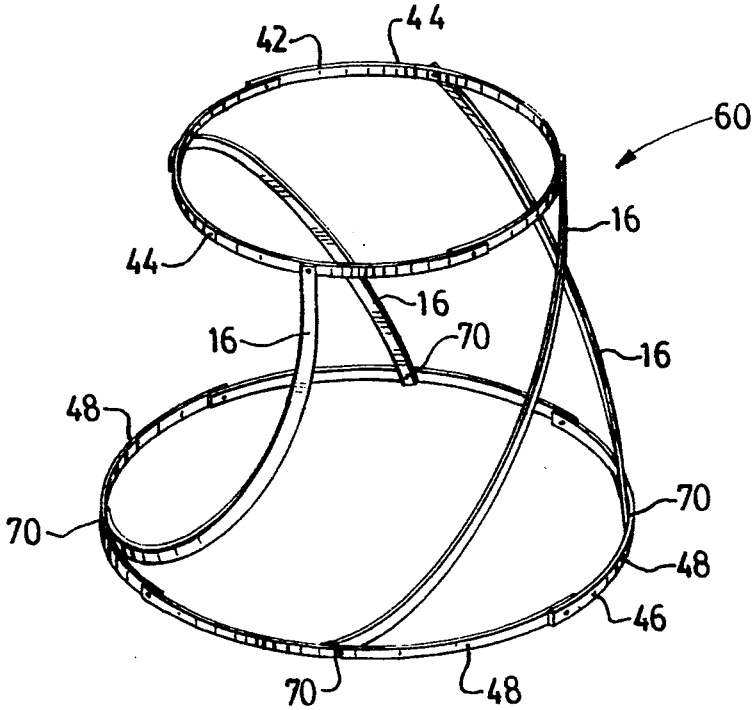
FIG. 15 is a perspective view of a third alternate embodiment of the bag holder of the present invention.
Figure 16:
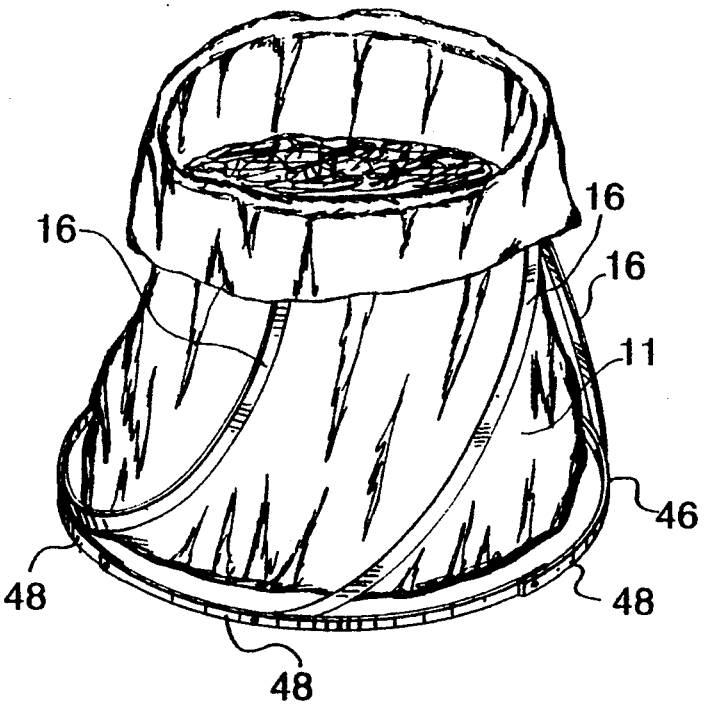
FIG. 16 is a perspective view of the bag holder of FIG. 15 showed holding a flexible bag filled which is filled with leaves.

FIGS. 15 and 16 shrew a third alternate embodiment, shown generally at 60, of a bag holder of the present invention and including a height adjustment feature. Struts 16 are attached to the upper support member 42 and the lower support member 44 such that each strut 16 can be prevented from reaching the position where it is perpendicular to the lower support member 46. Accordingly, if each strut does not reach the fully extended portion, when weight is put on the upper support member 42 the holder will tend to collapse until the weight on the upper support member 42 is reduced through the bag settling on the ground. Alternatively, if each strut is in the fully extended position where it is perpendicular to the lower support member, when weight is applied to the upper support member struts will bow and if enough weight is applied to the upper support member there is a risk that the struts would break. Where the struts are prevented from reaching the vertical, since the struts 16 are flexed the struts will tend to straighten and thus tend to the vertical and the upper support member 42 will still support the side of the bag. This embodiment allows for one bag holder to easily accommodate bags of different sizes in particular it will accommodate the oversized leaf bags and the regular garbage bag size. It will be appreciated that the upper support member, lower support member and struts can be those of either of the two embodiments described above.

Figure 18:
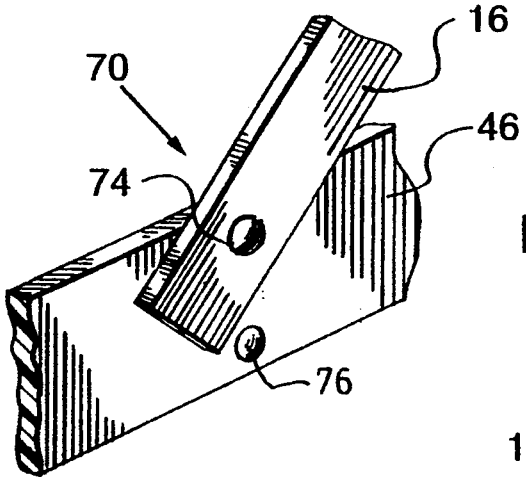
FIG. 18 is an enlarged perspective view of the attachment assembly of FIG. 17, shown in the height adjustment position.
Figure 17:
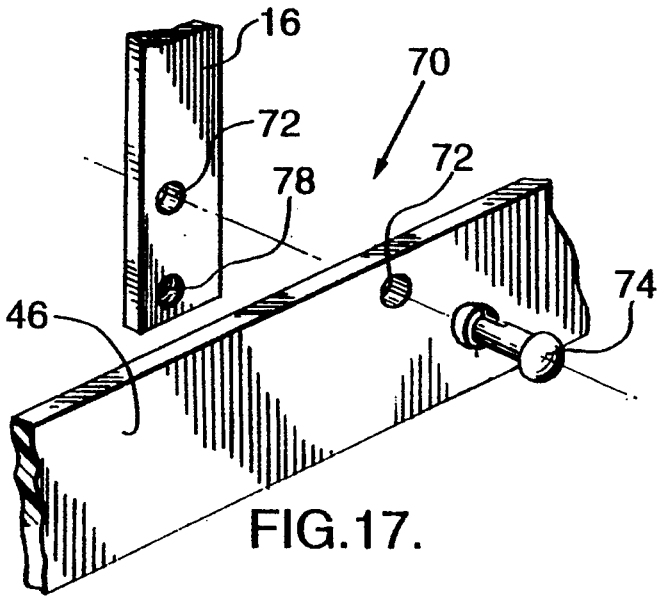
FIG. 17 is an enlarged blown apart perspective view of an attachment assembly for use with the bag holder of FIG. 15.
Figure 19:
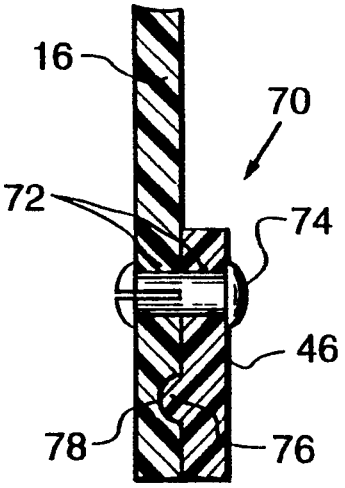
FIG. 19 is an enlarged sectional view of the attachment assembly of FIG. 17, shown in the engaged position.

Attachment assembly 70 for use with bag holder having a height adjustment feature is shown in FIGS. 17, 18 and 19. This attachment assembly is used to attach struts 16 to lower support member 46 for the embodiment shown in FIGS. 15 and 16 at reference 70. Attachment assembly 70 includes an aperture 72 in each of the strut and the lower support member for receiving a stud 74. Each assembly includes a detent 76 on lower support member 46 and an indent 78 on strut 16. Aperture 72 and indent 78 are positioned as close to the side of strut 16 as is practicable. Lower support member 46 is wider than embodiments described above, preferably 1 inch wide. Aperture 72 and indent 78 are as far apart as practicable. Where the user wishes bag holder 60 to be in the self adjusting position shown in FIGS. 15 and 16, the user merely allows the struts to go to as near the vertical as possible which will be where the side of the strut 16 engages the detent 76 as shown in FIG. 18. Preferably the angle formed between strut 16 and lower support member 46 is between 60 and 75 degrees. Alternatively, the user can position the strut 16 perpendicular to the lower support member by bringing the detent into engagement with the indent, as shown in FIG. 19.

It will be appreciated that the above description related to embodiments by way of example only. Many variations on the invention will be obvious to those skilled in the art and such obvious variations are within the scope of the invention as described herein whether or not expressly described. For example the upper and lower support members could be a shape other than a round. As well, the number of struts can be varied as determined by the manufacturer.

What is claimed as the invention is:

1. A collapsible bag holder for use with a flexible bag comprising:

a lower support member;

an upper support member;

a plurality of resiliently flexible struts having a top end portion, a bottom end portion and side portions, the top end portion of each strut being connected to the upper support member and the bottom end portion of each strut being connected to the lower support member wherein the bag holder has an operative position where the upper support member is vertically spaced from the lower support member and a collapsed position where the lower support member, the upper support member and the plurality of struts are generally in the same plane and the bag holder is moved from the operative position to the stored position by twisting the upper support member relative to the lower support member and pushing the upper support member and the lower support member into the same plane;

means for pivoting the top end portion of each flexible strut in a plane tangential to the upper support member; and means for pivoting the bottom end portion of each flexible strut in a plane tangential to the lower support member.

2. A bag holder as claimed in claim 1 wherein the upper support member and the lower support member are circular, each having an outside and an inside and wherein the top end portion of the strut is attached to the outside of the upper support member and the bottom end portion of the strut is attached to the inside of the lower support member.

3. A bag holder as claimed in claim 2 wherein the upper support member has a circumference that is less than the circumference of the flexible bag.

4. A bag holder as claimed in claim 3 wherein the lower support member has a circumference that is greater than the circumference of the distended flexible bag.

5. A bag holder as claimed in claim 4 wherein the upper support member comprises a plurality of upper segments which are attached in end to end relation and the lower support member comprises a plurality of lower segments attached in end to end relation.

6. A bag holder as claimed in claim 5 wherein there are three upper segments, three lower segments and three struts and wherein the three struts are attached equidistant around the upper support member and the lower support member.

7. A bag holder as claimed in claim 4 wherein the upper support member comprises two pivotally attached sections of equal length wherein each sections is pivotal towards the other section and further comprising a holding means to hold the two sections in end to end relation.

8. A bag holder as claimed in claim 7 wherein the lower support member comprises four lower segments attached in end to end relation and four struts are spaced equidistant around the lower support member and the upper support member.

9. A bag holder as claimed in claim 8 wherein the holding means comprises a detent extending outwardly from one section towards the other section and a corresponding indent in the other section such the detent engages the indent when the sections are in end to end relation and such that pressure on the section releases the detent from the indent.

10. A bag holder as claimed in claim 9 further including a preventing means to prevent each strut from reaching the vertical position such that each strut remains slightly flexed and pressure on the upper support member will tend to bring the upper support member closer to the lower support member.

11. A bag holder as claimed in claim 10 wherein the preventing means comprises a detent extending inwardly from the inside of the lower support member positioned to engage a side portion of each strut such that the strut is slightly off the vertical.

12. A bag holder as claimed in claim 4 further including a preventing means to prevent each strut from reaching the vertical position such that each strut remains slightly flexed and pressure on the upper support member will tend to bring the upper support member closer to the lower support member.

13. A bag holder as claimed in claim 12 wherein the preventing means comprises a detent extending inwardly frown the inside of the lower support member positioned to engage a side portion of each strut such that the strut is slightly off the vertical.

14. A bag holder kit for use with a flexible bag, comprising:

a plurality of generally planar flexible lower segments, each lower segment having a lower aperture formed in each end thereof and the plurality of lower segments having strut apertures formed therein extending through the thickness of the lower segments, the lower segments being adapted to be attached together in end to end relation to form a lower support member;

a plurality of generally planar flexible upper segments, each upper segment having an upper aperture formed in each end thereof and the plurality of upper segments having strut apertures formed therein extending through the thickness of the upper segments, the upper segments being adapted to be attached together in end to end relation to form an upper support member;

a plurality of resiliently flexible struts each having a top end portion, a bottom end portion and side portions, the top end portion having a strut aperture formed therein and the bottom end portion having a strut aperture formed therein;

a plurality of lower studs dimensioned to fit snugly into said lower apertures;

a plurality of upper studs dimensioned to fit snugly into said upper strut apertures;

a plurality of strut studs dimensioned to fit into said strut apertures so that the longitudinal axis of each strut stud extends radially to the assembled lower and upper segments and allows for pivoting in a plane tangential to each of the upper support members and lower support members; and wherein the bag holder when assembled has an operative position where the upper support member is vertically spaced from the lower support member and a collapsed position where the lower support member, the upper support member and the plurality of struts are generally in the same plane and the bag holder is moved from the operative position to the stored position by twisting the upper support member relative to the lower support member and pushing the upper support member and the lower support member into the same plane.

15. A bag holder kit as claimed in claim 14 wherein the lower segments are attached in end to end relation with a lower stud being position through the lower apertures of adjacent lower segments and wherein the first lower segment has an empty lower aperture in one end thereof and the last lower segment has a lower stud extending through the lower aperture in one end thereof and being ready to connect with the empty lower aperture and wherein the strut studs are positioned in the lower segments such that the strut studs extend inwardly from the lower segments and wherein the upper segments are attached in end to end relation with a upper stud being position through the upper apertures of adjacent upper segments and wherein the first uppers segment has an empty upper aperture in one end thereof and the last upper segment has an upper stud extending through the upper aperture in one end thereof and being ready to connect with the empty upper aperture and wherein the strut studs are positioned in the upper segments such that the strut studs extend outwardly from the upper segments.

16. A bag holder kit as claimed in claim 15 wherein the cumulative distance between the upper apertures of each upper segment is less than the circumference of the distended flexible bag.

17. A bag holder kit as claimed in claim 16 wherein when the cumulative distance between the lower apertures of each upper segment is greater than the circumference of the flexible bag.

18. A bag holder kit as claimed in claim 17 wherein there are three upper segments, three lower segments and three struts and wherein each upper segment has said strut aperture in the centre thereof and each lower segment has said strut aperture in the centre thereof and when assembled the three struts are attached equidistant around the upper support member and the lower support member.

19. A bag holder kit as claimed in claim 17 wherein there are two upper segments and wherein when assembled the upper support member comprises two pivotally attached sections of equal length wherein each sections is pivotal towards the other section and further comprising a holding means to hold the two sections in end to end relation.

20. A bag holder kit as claimed in claim 19 wherein there are four lower segments and each lower segment has said strut aperture in the centre thereof and each upper support member has two of said strut apertures formed therein.

21. A bag holder kit as claimed in claim 20 wherein the holding means comprises a detent extending outwardly from one section towards the other section and a corresponding indent in the other section such the detent engages the indent when the sections are in end to end relation and such that pressure on the section releases the detent from the indent.

22. A bag holder kit as claimed in claim 21 further including a preventing means to prevent each strut from reaching the vertical position such that each strut remains slightly flexed and pressure on the upper support member will tend to bring the upper support member closer to the lower support member.

23. A bag holder kit as claimed in claim 22 wherein the preventing means comprises a detent extending inwardly from the inside of the lower support member positioned to engage a side portion of each strut such that the strut is slightly off the vertical.

24. A bag holder kit as claimed in claim 17 further including a preventing means to prevent each strut from reaching the vertical position such that each strut remains slightly flexed and pressure on the upper support member will tend to bring the upper support member closer to the lower support member.

25. A bag holder kit as claimed in claim 24 wherein the preventing means comprises a detent extending inwardly from the inside of the lower support member positioned to engage a side portion of each strut such that the strut is slightly off the vertical.

* * * * *